US005981894A

United States Patent [19]

Kammerl et al.

[11] Patent Number: 5,981,894

[45] **Date of Patent: *Nov. 9, 1999**

[54] METAL-ENCLOSED, GAS-INSULATED SWITCHGEAR ASSEMBLY

[75] Inventors: Kurt Kammerl, Klettgau, Germany; Markus Vestner, Büsingen; Martin Zürcher, Watt, both of Switzerland

[73] Assignee: Asea Brown Boveri AG, Baden, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/032,797

[22] Filed: Mar. 2, 1998

[30] Foreign Application Priority Data

Apr. 17, 1997 [DE] Germany ..... 197 16 022

[51] Int. Cl.[6] ..... H01H 33/02; H01H 33/08

[52] U.S. Cl. ..... 218/155; 218/123; 218/146

[58] Field of Search ..... 218/48, 49, 50, 218/51, 65, 74, 107, 123, 146, 155

[56] References Cited

U.S. PATENT DOCUMENTS 4,628,164 12/1986 Talpo ..... 218/75

5,483,031 1/1996 Matsuda ..... 218/48

FOREIGN PATENT DOCUMENTS

0382323B1 8/1990 European Pat. Off. .

*Primary Examiner*—Lincoln Donovan

*Attorney, Agent, or Firm*—Burns, Doane, Swecker & Mathis, L.L.P.

[57] ABSTRACT

A metal-enclosed, gas-insulated switchgear assembly having at least one active part (19) is mounted in an enclosure extended along an axis (18). The active part (19) is provided on at least one side with a contact-making assembly (25). The contact-making assembly (25*a*) is electrically conductively connected to a connecting part (26) which is provided with a shielding electrode (28). The shielding electrode (28) is connected to a supporting element (35) which bounds an intermediate area (40). The supporting element (35) is connected, on the side facing away from the shielding electrode (28), to a fitting (37) which has holes (39) which originate from the intermediate area (40) and are designed to hold fixing screws. The connecting part (26) is designed for advantageously simply assembly. The connecting part (26) dielectrically shields the heads of the fixing screws.

10 Claims, 3 Drawing Sheets

METAL-ENCLOSED, GAS-INSULATED SWITCHGEAR ASSEMBLY

BACKGROUND OF THE INVENTION

1. Field of the Invention

The invention is based on a metal-enclosed, gas-insulated switchgear assembly as claimed in the preamble of claim 1.

2. Discussion of Background

Patent Specification EP 0 382 323 B1 discloses a power breaker for a metal-enclosed, gas-insulated switchgear assembly, which has a connecting part for electrical connection on the side of a quenching chamber facing away from the drive. This connecting part is designed advantageously in dielectric terms and is electrically conductively connected to the active part of the bushing. The heads of the screws which rigidly connect the connecting part to the said active part of the bushing are covered by a metallic shield, which acts as dielectric shield. When the connecting part is being fitted and removed, this shroud must also always be fitted, and respectively, removed, which involves additional assembly complexity.

SUMMARY OF THE INVENTION

Accordingly, one object of the invention as it is defined in patent claim 1 is to provide a novel metal-enclosed, gas-insulated switchgear assembly, which can be produced with little assembly complexity.

The metal-enclosed, gas-insulated switchgear assembly is provided with at least one active part which is mounted in an enclosure extended along an axis and has a contact-making assembly on at least one side. The contact-making assembly is electrically conductively connected to at least one connecting part which is provided with a shielding electrode. The shielding electrode is connected to two supporting pillars, which bound an intermediate area or to a U-section. The two supporting pillars, or the U-profile, are or is connected, on the side facing away from the shielding electrode, to a fitting which has holes which originate from the intermediate area and are designed to hold fixing screws. The fixing screws for the connecting part are arranged in a dielectrically shielded manner in the intermediate area between the supporting pillars, or between the limbs of the U-section, so that they can be fitted and removed particularly easily and quickly.

The intermediate area between the supporting pillars extends in the direction of the axis, and the intermediate area in the case of the U-section opens on the side facing away from the drive side, which advantageously simplifies access to the fixing screws from the end of the enclosure.

The connecting part has a centrally arranged shielding electrode. The side of the contact-making assembly facing the shielding electrode is provided with gas drying means which are introduced between a contact support and a cover. These gas drying means are located, when the contact-making assembly is definitively retracted, within the volume of the interior of the shielding electrode, but which ensures that the insulating gas has access to the gas drying means in a simple way. During overhauls, the gas drying means are removed together with the active parts from the enclosure, this being the switching enclosure in the exemplary embodiment, and can be replaced very easily during such an opportunity.

These advantageously designed components may be used both for single-phase enclosed switchgear assemblies and for multiphase enclosed switchgear assemblies.

An exemplary embodiment of the invention and the advantages which can be achieved with it are explained in more detail in the following text with reference to the drawing, which illustrates only one possible design option.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only those elements which are required for direct understanding of the invention are illustrated.

DESCRIPTION OF THE PREFERRED EMBODIMENTS

Figure 1:
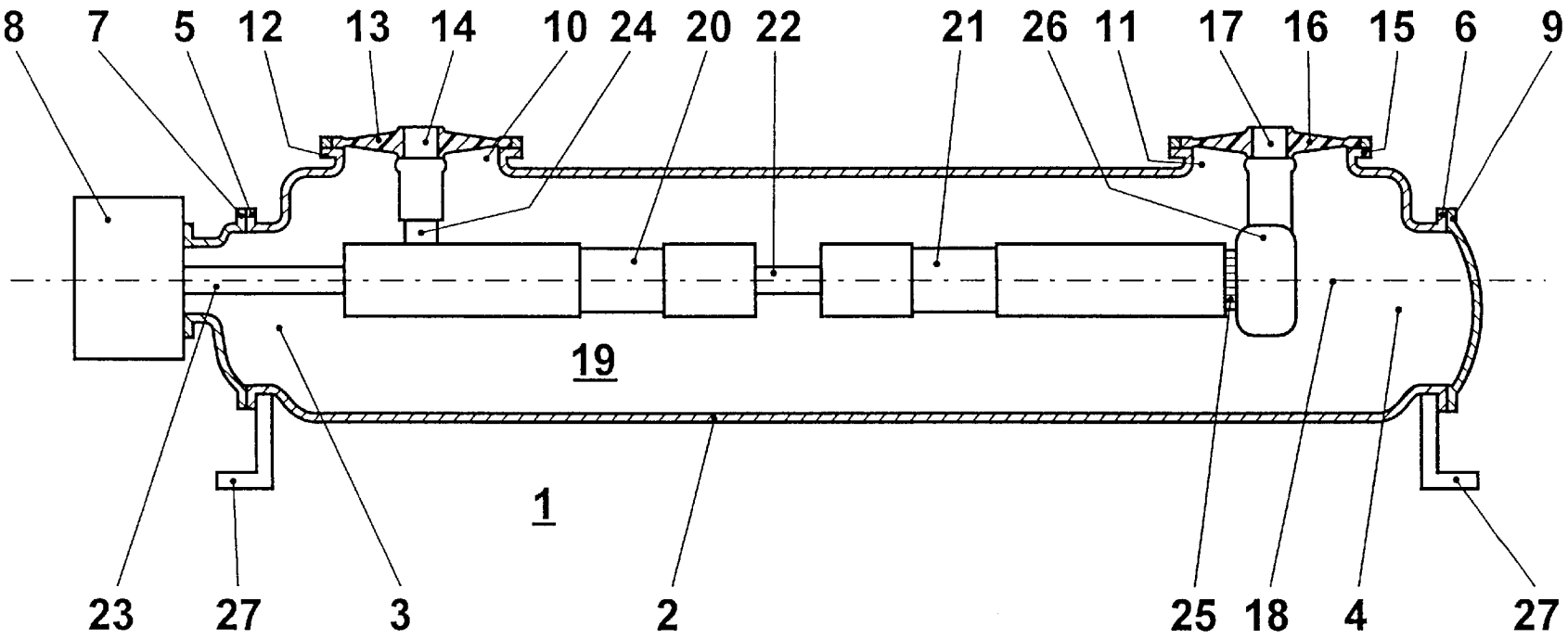
FIG. 1 shows a schematically illustrated section through a power breaker for a metal-enclosed, gas-insulated switchgear assembly according to the invention.

Referring now to the drawings, wherein like reference numerals designate identical or corresponding parts throughout the several views, FIG. 1 shows a section through a power breaker 1 for a metal-enclosed, gas-insulated switchgear assembly. The power breaker 1 has a switch enclosure 2 which is essentially cylindrical and is manufactured from a metal or a metal alloy. Two identical openings 3 and 4 of equal size are provided at both ends of the switch enclosure 2 and are each provided with a flange 5 and 6, the opening 3 being associated with the flange 5, and the opening 4 with the flange 6. The opening 3 is closed by a cover 7 which is screwed in a pressuretight manner to the flange 5 and to which a drive 8 is flange-connected in a pressuretight manner on the side facing away from the flange 5. A closure cover 9 is mounted on the flange 6 and closes the opening 4 in a pressuretight manner.

The top of the switch enclosure 2 is provided on both sides with two further openings 10 and 11, through which the electrical connections are introduced into the power breaker 1. The opening 10 on the drive side is provided with a flange 12 and is closed in a pressuretight manner by a supporting insulator 13 designed as a partition insulator. The supporting insulator 13 has an electrically conductive cast fitting 14 in the center. Other parts of the metal-enclosed, gas-insulated switchgear assembly, which are not illustrated but are supported on the switch enclosure 2, are screwed to the flange 12. The opening 11 facing away from the drive 8 is provided with a flange 15 and is closed in a pressuretight manner by a supporting insulator 16 designed as a partition insulator. In the center, the supporting insulator 16 has an electrically conductive cast fitting 17. Other parts of the metal-enclosed, gas-insulated switchgear assembly, which are supported on the switch enclosure 2 and are not illustrated here, are screwed to the flange 15.

The active parts 19 of the power breaker 1 extend along an axis 18 and in this case are composed, for example of two series-connected quenching chambers 20 and 21, which are held together by an electrically conductive connecting piece 22. As a rule, the axis 18 does not coincide with the longitudinal axis of the switch enclosure 2, but runs parallel to it. On the drive side, the quenching chamber 20 is connected to the drive 8 by an operating rod 23 made of an insulating material. The quenching chamber 21 is likewise connected to the drive 8 by an operating unit, which is not illustrated. The moving operating rod 23 is introduced in a pressuretight manner into the interior of the switch enclosure 2. Various solutions are known for introducing the operating rod 23 in a pressuretight manner, and there is therefore no need to go into the specific design here. The operating rod 23 may, in addition, also be supported with respect to the cover 7 by an additional supporting insulator. Once again, widely different variants are possible for the configuration of the flange connection of the drive 8 to the cover 7.

On the drive side, the quenching chamber 20 is connected to the cast fitting 14 via an electrically conductive connecting piece 24. A contact-making device, which can easily be detached and simplifies the extension of the active parts 19, is integrated in the connecting piece 24. On the side facing away from the drive 8, the quenching chamber 21 is provided with a contact-making assembly 25, which is pushed into a connecting part 26. The connecting part 26 is manufactured from a metal, preferably being cast from an aluminum alloy, and is electrically conductively connected to the cast fitting 17 of the supporting insulator 16. The active parts 19 are held mechanically by the two supporting insulators 13 and 16. However, as a rule, the quenching chamber 20 is also supported in an insulated manner on the drive side, but this support is not illustrated here.

The switch enclosure 2 is filled with a pressurized insulating medium, preferably $SF_6$ gas. The switch enclosure 2 is fitted with two feet 27 for mounting the power breaker 1 on a base, which is not illustrated in the figure.

Figure 2A:
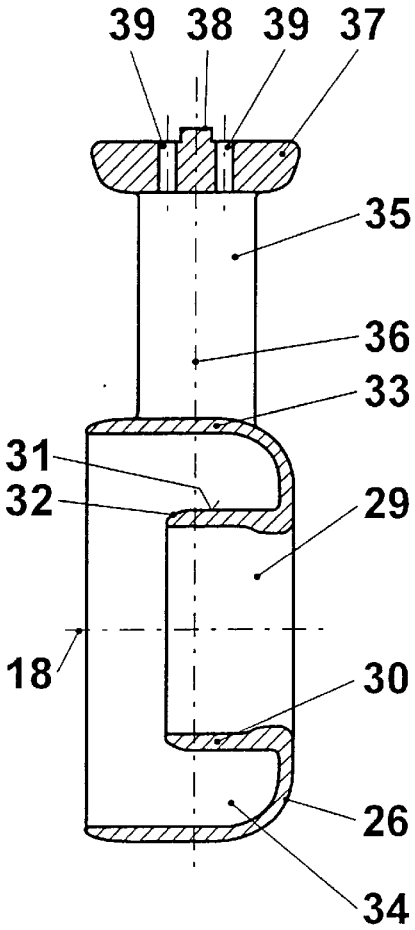
FIG. 2*a* shows the section A—A through the connecting part indicated in FIG. 2.
Figure 2:
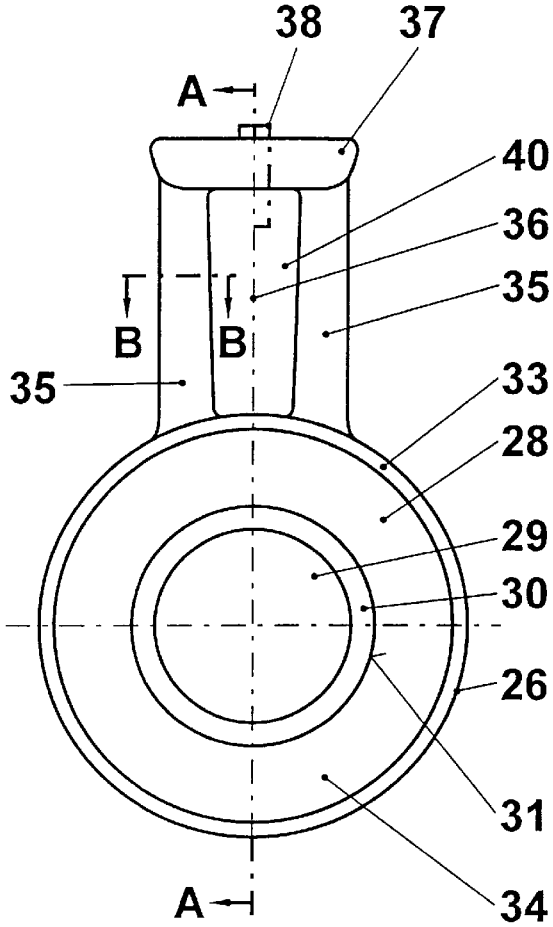
FIG. 2 shows a plan view of a first embodiment of a connecting part for making contact in the power breaker.

FIG. 2 shows a plan view of a first embodiment of the connecting part 26, to be precise seen from the drive side of the power breaker 1. The connecting part 26 has a toroidal shielding electrode 28 which is designed in a dielectrically advantageous manner. A cylindrical opening 29 is provided in the center of the shielding electrode 28 and is arranged concentrically about the axis 18. In the radial direction, the opening 29 is bounded by an intermediate wall 30, whose side facing away from the opening 29 is designed as a cylindrical contact surface 31 which is provided with a chamfer 32 on the drive side, as can be seen in FIG. 2*a*. A volume 34, which opens wide on the drive side, is provided between the intermediate wall 30 and an outer wall 33 of the shielding electrode 28.

Figure 2B:
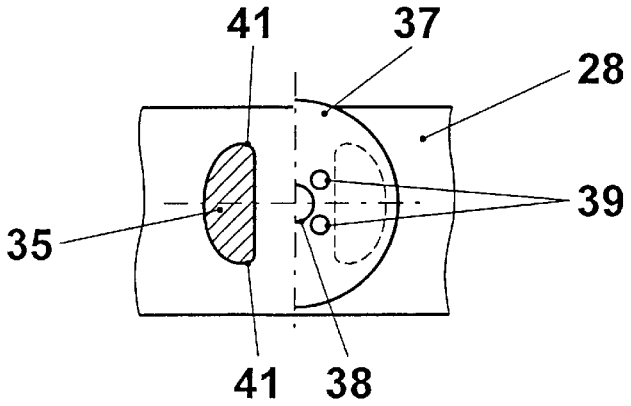
FIG. 2*b* shows the partial section B—B through the connecting part indicated in FIG. 2.

Two supporting pillars 35 are integrally formed on the surface of the shielding electrode 28, which supporting pillars 35 are at a distance from one another, are designed in a dielectrically advantageous manner and are arranged symmetrically with respect to a center axis 36. On the side of the supporting pillars 35 facing away from the shielding electrode 28, a fitting 37 is integrally formed on these supporting pillars 35, which fitting 37 connects said supporting pillars 35 and is designed in a dielectrically advantageous manner. In the center on the side facing away from the shielding electrode 28, the fitting 37 has a centering pin 38, which fits into a corresponding depression in the cast fitting 17 of the supporting insulator 16. The fitting 37 is provided with four holes 39 which hold the fixing screws for connecting the fitting 37 to the cast fitting 17. The heads of the fixing screws are in this case arranged such that they are located in the intermediate area 40 between the supporting pillars 35. The heads of the fixing screws are dielectrically shielded by the supporting pillars 35, so that their edges cannot have any negative effect on the electrical field in the region of the fitting 37. FIG. 2*b* shows the partial section B—B through the connecting part indicated in FIG. 2. This partial section shows the cross section through a supporting pillar 35 which is designed in a dielectrically advantageous manner and has comparatively large radii 41, which have a shielding effect, on both sides of the intermediate area 40. The intermediate area 40 opens in the axial direction so that, once the closure cover 9 has been removed, the heads of the fixing screws are very easily accessible through the opening 4, so that these fixing screws can be undone and fitted very quickly and easily.

The two supporting pillars 35 may also be replaced by a single U-section 50 which is cast from a metal or a metal alloy, is designed in a dielectrically advantageous manner and is open on the side of the power breaker facing away from the drive. This second embodiment of the connecting part 26 also ensures that the screw heads are very effectively dielectrically shielded, and that the heads of the fixing screws are very easily accessible through the opening 4, so that the fixing screws can be undone and fitted very quickly and easily.

Figure 3:
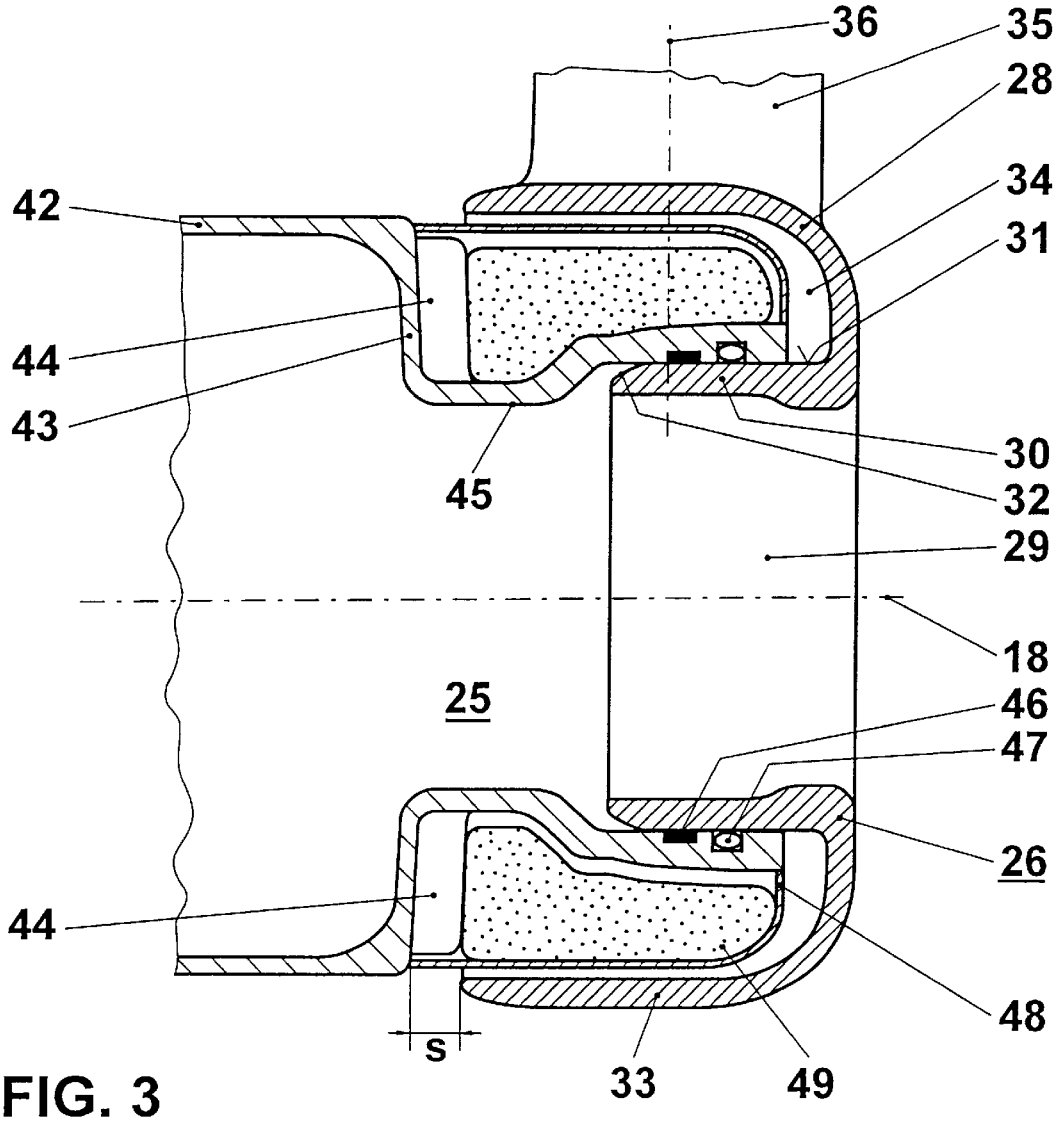
FIG. 3 shows a partial section through the connecting part with the mating contact retracted.

FIG. 3 shows a partial section through the connecting part 26 with the contact-making assembly 25 retracted. The contact-making assembly 25 comprises an axially extended enclosure 42 made of a metal or a metal alloy, which is electrically conductively connected to the quenching chamber 21. The enclosure 42 has a wall 43, which is directed radially inward and is provided with radially extending ribs 44 on the side facing the connecting part 26. An essentially axially extending contact support 45 encloses the intermediate wall 30 of the shielding electrode 28 and is connected to the wall 43, which is directed radially inward. A guide ring 46 which is made of a synthetic material and rests on the contact surface 31 is introduced into the side of the contact support 45 facing the contact surface 31. In addition, a groove is incorporated in the side of the contact support 45 facing the contact surface 31, into which groove a spiral contact 47 is inserted which ensures that electrical contact is made between the contact-making assembly 25 and the connecting part 26. During insertion, the spiral contact 47 makes contact first and, immediately after this, the guide ring 46 relieves the mechanical load on the spiral contact 47. The chamfer 32 simplifies the retraction of the contact-making assembly 25 and is used to cater for tolerances between the connecting part 26 and the contact-making assembly 25. The spiral contact 47 could alternatively be introduced in the contact surface 31, in the same way as the guide ring 46.

The exhaust gases escape through the opening 29 in both of the embodiments shown. It is conceivable that the bend in the contact support 45, which is provided here to protect the electrical contact region against these gases and erosion particles, may be inadequate. In this case, it is very easily possible to design the contact region to be positioned radially outward, so that the outer wall 33 of the shielding electrode 28 can be used to make contact with the correspondingly modified contact-making assembly 25. If the connecting part 26 is not used in the power breaker region, then the opening 29 can be provided with a cover directly, although in this case it is necessary to ensure that the cover is designed in a dielectrically advantageous manner.

The external contour of the enclosure 42 is continued by means of a cover 48 as far as the front edge of the contact support 45. This cover 48, which is connected to the enclosure 42 and is centered by the outer edge of the ribs 44, is manufactured from a perforated material, for example from a perforated metal sheet or from a synthetic material. The majority of a cavity between this cover 48, the contact support 45 and the ribs 44 is filled with a gas drying means 49, which is packed in a gas-permeable bag.

A gap s with respect to the gas-filled interior of the switch enclosure 2 remains open between the outer wall 33 of the shielding electrode 28 and the wall 43 of the enclosure 42 and makes it easier for the insulating gas to enter the radially arranged intermediate areas between the ribs 44, and thus to reach the gas drying means 49. The region around the gap s is designed such that it has no disturbing effect dielectrically. The contact support 45 may be provided with radially extending apertures in order to improve the gas circulation through the gas drying means 49.

Figure 4:
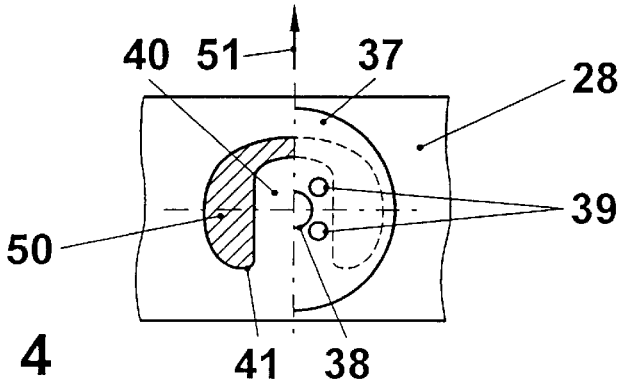
FIG. 4 shows a partial section, similar to the partial section shown in FIG. 2*b*, through a second embodiment of the connecting part.

FIG. 4 shows a partial section through a second embodiment of the connecting part 26, and to be precise a U-section 50 is provided here instead of the two supporting pillars 35, which U-section 50 is designed in a dielectrically advantageous manner and connects the fitting 37 to the shielding electrode 28. This U-section 50 is arranged such that its intermediate area 40 opens in the opposite direction to the drive side. An arrow 51 in this FIG. 4 indicates the direction of the drive 8.

The figures will now be considered in more detail in order to explain the method of operation. The two openings 3 and 4 in the switch enclosure 2 are designed such that the active parts 19 can be extended and removed from the switch enclosure 2 from both sides. If the operating access path for removing the quenching chambers 21 and 20 is provided on the side facing away from the drive 8, then the quenching chambers 20 and 21 are extended on this side after removal of the drive 8, and are then removed in sequence. The operating access path is designed in a correspondingly advantageous manner to be narrow and, as a rule, in this case is designed to be only slightly wider than is necessitated by the length of the quenching chambers 20 and 21 removed through it. However, in this case, the connecting part 26 must also be removed before the quenching chambers 20 and 21, are extended in order to clear the way for the extension process.

The connecting part 26 can be removed from the opening 4 in a very simple manner, since there is no additional shielding on the fixing screws that needs to be removed carefully. The axially extending intermediate area 40 between the supporting pillars 35, or between the limbs of the U-section 50, allows access without any problems in the axial direction of the opening 4 for tools to undo the four fixing screws which connect the connecting part 26 to the cast fitting 17 of the supporting insulator 16. Once the fixing screws have been undone and removed, the connecting part 26 can easily be pulled off the contact support 45 and removed. The connecting part 26 can likewise be fitted in a very simple manner, since there is no need to fit and adjust any additional shielding for the fixing screws. The centering pin 38 makes it easier to position the connecting part 26 correctly during fitting, and there is therefore no need for any complex alignment of the connecting part 26. In order to ensure the correct axial alignment of the connecting part 26 in a simple manner, an additional locating pin may, if necessary, be inserted into the surface of the fitting 37 facing the cast fitting 17, to engage in a corresponding hole in the surface of the cast fitting 17. The described plug-in connection process effectively compensates for axial tolerances and thermal expansion.

It is particularly advantageous that the volume 34 in the interior of the shielding electrode 28, which is necessarily produced as a result of the dielectrically advantageous shaping of this shielding electrode 28, can in this case be used to accommodate the gas drying means 49, so that there is no need to fit additional assemblies in order to position the gas drying means 49, which are always required, in the switch enclosure 2. As a rule, such additional assemblies are positioned in bulges in the wall of the switch enclosure 2, in order to shield them dielectrically. Such bulges increase the cost of the switch enclosure 2 and make it harder to clean it, and in this case they may be omitted. Furthermore, it is advantageous that, during overhauls, the gas drying means 49 are removed together with the active parts 19 so that said means are then very easily accessible and can be replaced very easily and simply outside the switch enclosure 2. The assembly effort is thus advantageously kept low.

The concept of this metal-enclosed, gas-insulated switchgear assembly allows the operating access path to be arranged either on the drive side of the switchgear assembly or on the side facing away from the drive 8. This variable switchgear assembly concept allows the switchgear assembly to be matched optimally to the respective physical characteristics and to the customers' wishes. The connecting part 26, which can be fitted and removed easily and quickly, facilitates this advantageous switchgear assembly concept without significantly increasing the assembly effort.

The principle of utilizing the unused space in the interior of shielding electrodes 28 to accommodate the gas drying means 49 can be applied in a general advantageous manner to metal-enclosed, gas-insulated switchgear assemblies, providing free access of the $SF_6$ gas to the gas drying means 49 is ensured.

The connecting part 26 may also advantageously be used for cost-effective and space-saving angled connections at other points in the metal-enclosed, gas-insulated switchgear assembly, for example for bends in busbars. The corresponding gas areas in the switchgear assembly may thus also be provided with the gas drying means, without any major complexity.

In the exemplary embodiment, the fitting of the connecting part 26 in a horizontally arranged enclosure is described, but it is in principle possible to provide the advantageously designed connecting part 26, with the contact-making assembly 25 that engages in it, in vertically arranged enclosures as well.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A metal-enclosed, gas-insulated switchgear assembly comprising:

at least one active part which is mounted in an enclosure extended along an axis and has a contact-making assembly on at least one side, at least one connecting part which is provided with a shielding electrode and can be connected in an electrically conductive manner to the contact-making assembly, wherein the shielding electrode of the connecting part is connected to a supporting element which bounds an intermediate area, said supporting element including a structure selected from the group consisting of two separate supporting pillars which bound said intermediate area and a member having a U-shaped cross-section which bounds said intermediate area, wherein the supporting element is connected, on the side facing away from the shielding electrode, to a fitting, and wherein the fitting has holes which originate from the intermediate area and are designed to hold fixing screws.

2. The switchgear assembly as claimed in claim 1, wherein the holes for holding the fixing screws are arranged in the dielectrically shielded region of the intermediate area.

3. The switchgear assembly as claimed in claim 1, wherein the supporting element is formed from two separate supporting pillars.

4. The switchgear assembly as claimed in claim 3, wherein the intermediate area between the supporting pillars opens in the direction of the axis.

5. The switchgear assembly as claimed in claim 2, wherein the supporting element is formed from a member having a U-shaped cross-section.

6. The switchgear assembly as claimed in claim 5, wherein the intermediate area between the limbs of the U-section opens axially on the side opposite the drive.

7. The switchgear assembly as claimed in claim 1, wherein the connecting part is designed as an element which can be removed in one piece.

8. A metal-enclosed, gas-insulated switchgear assembly comprising:

at least one active part which is mounted in an enclosure extended along an axis and has a contact-making assembly on at least one side, at least one connecting part which is provided with a shielding electrode and can be connected in an electrically conductive manner to the contact-making assembly, wherein the shielding electrode of the connecting part is connected to a supporting element which bounds an intermediate area, wherein the supporting element is connected, on the side facing away from the shielding electrode, to a fitting, wherein the fitting has holes which originate from the intermediate area and are designed to hold fixing screws, wherein the shielding electrode, which is arranged concentrically with respect to the axis, has an annular volume for holding the contact-making assembly, and wherein the shielding electrode has a cylindrical intermediate wall which extends in the direction of the contact-making assembly and on which a contact support of the retracted contact-making assembly is supported.

9. The switchgear assembly as claimed in claim 8, wherein the side of the contact-making assembly which faces the shielding electrode is provided with gas drying means which are introduced between the contact support and a cover, and wherein this gas drying means is located within the volume of the shielding electrode when the contact-making assembly is definitively retracted.

10. The switchgear assembly as claimed in claim 9, wherein a circumferential gap is provided between the shielding electrode and a further enclosure, and wherein a radially running wall of the enclosure is provided with ribs which run radially and extend axially, such that the intermediate areas between the ribs are open to the outside in the region of the gap.

* * * * *